United States Patent [19]

Takahashi

[11] Patent Number: 4,474,553

[45] Date of Patent: Oct. 2, 1984

[54] PROCESS AND APPARATUS FOR DRYING OR HEATING A PARTICULATE MATERIAL

[75] Inventor: Shiro Takahashi, Yokohama, Japan

[73] Assignee: Asahi Glass Company, Ltd., Tokyo, Japan

[21] Appl. No.: 407,947

[22] Filed: Aug. 13, 1982

[30] Foreign Application Priority Data

Sep. 24, 1981 [JP] Japan ..... 56-140527[U]
Jan. 19, 1982 [JP] Japan ..... 57-4490[U]

[51] Int. Cl.[3] ..... F27B 15/00; F28B 3/00
[52] U.S. Cl. ..... 432/27; 165/111; 432/197; 432/215
[58] Field of Search ..... 432/27, 197, 215; 165/111

[56] References Cited

U.S. PATENT DOCUMENTS

| | | | |
|---|---|---|---|
| 2,624,556 | 1/1953 | Kistler | 432/215 |
| 3,401,923 | 9/1968 | Bearce | 432/215 |
| 4,094,633 | 6/1978 | Peterson et al. | 432/215 |
| 4,353,725 | 10/1982 | Hohman et al. | 165/111 |

FOREIGN PATENT DOCUMENTS

| | | | |
|---|---|---|---|
| 1946380 | 3/1970 | Fed. Rep. of Germany . | |
| 1411055 | 8/1965 | France . | |
| 1498519 | 9/1967 | France . | |
| 7701055 | 11/1978 | France . | |
| 1079438 | 8/1967 | United Kingdom | 165/111 |
| 1203286 | 8/1970 | United Kingdom | 165/111 |

*Primary Examiner*—John J. Camby
*Attorney, Agent, or Firm*—Oblon, Fisher, Spivak, McClelland & Maier

[57] ABSTRACT

A process and apparatus for drying or heating a particulate material by means of heat transfer media which is brought into direct contact with the particulate material within a continuously rotating cylindrical drum. The particulate material flows in one general overall direction through the drum and the heat transfer media flows in a generally opposite direction through the drum. The particulate material is subjected to heat treatment by repeatedly coming into direct and immediate physical contact with the heat transfer media in the course of flowing through the drum while it is subsequently separated from the heat transfer media per revolution of the drum.

32 Claims, 16 Drawing Figures

FIG. 10
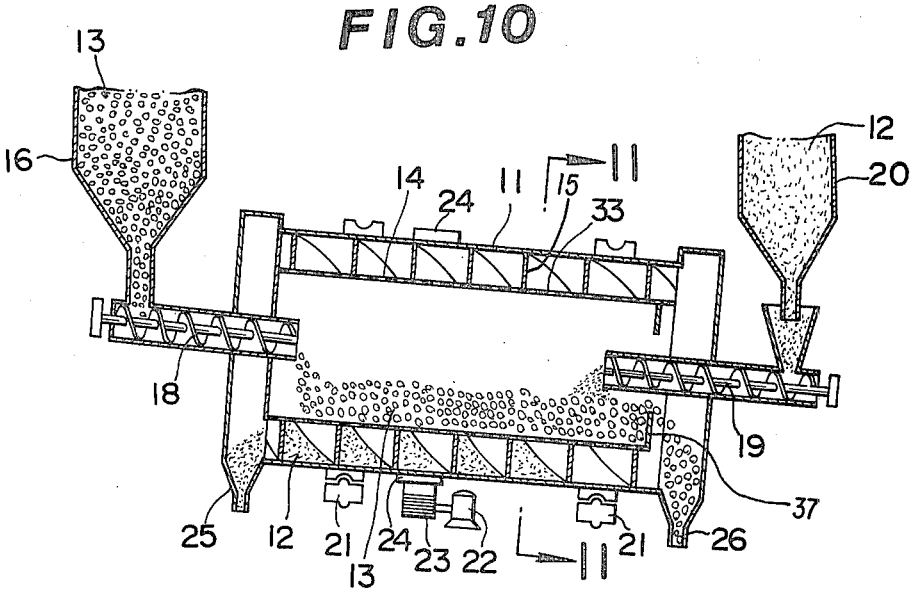
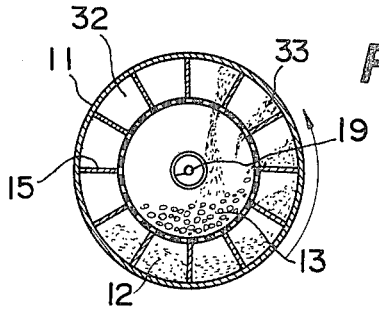
FIG. 11
FIG. 12
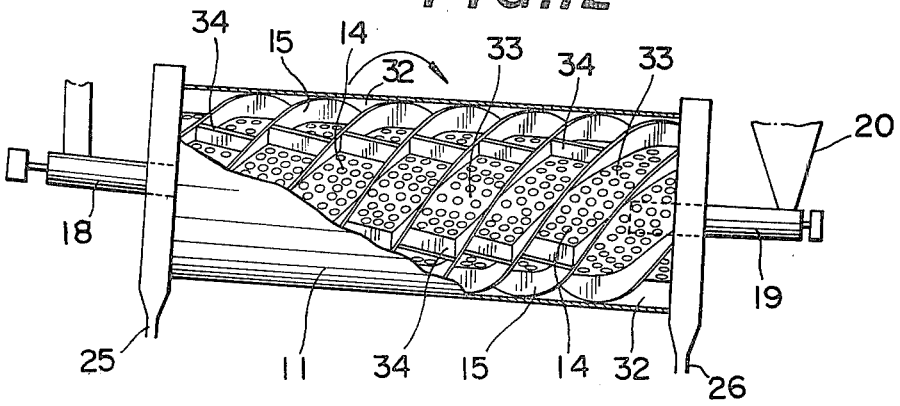

PROCESS AND APPARATUS FOR DRYING OR HEATING A PARTICULATE MATERIAL

BACKGROUND OF THE INVENTION

1. Field of the Invention

This invention is concerned with a process and apparatus for heating a particulate material by directly contacting with heat transfer media within a continuously rotating cylindrical drum.

2. Description of the Prior Art

It is known in the art to effect heat exchange between piece-shaped materials and heated or cooled loose balls by directly contacting the material being treated with the heat carrying balls in a rotary heat exchanger which is rotated around a substantially horizontal axis. In the rotary heat exchanger, the material is introduced into the drum from one end of the drum and the heat carrying balls are introduced into the other end of the drum. During the rotation of the drum, the material and the heat carrying balls are brought into direct contact with each other in the drum and the material flows in one direction through the drum and the heat carrying balls flow in the opposite direction through the drum.

The rotary heat exchanger known in the art is generally not capable of effectively causing the countercurrent flow of the material and the heat carrying balls in th drum. The reason for this is that the heat exchanger is rotated around the horizontal axis and that the material in such a rotary device is agitated in a relatively resting position. Furthermore, this type of apparatus exposes only a small heat exchanger area of the material with the result that direct heat transfer between the heat carrying balls and the material as a whole is not efficient. It may be possible to incline the heat exchanger at an angle so as to effect the countercurrent flow of the material and the heat carrying balls satisfactorily in the drum. In this instance, the heat exchanger must be rotated at a relatively high speed for causing the heat carrying balls to flow from the low end to the high end of the drum which results in contamination or segregation of the material due to abrasion of the heat carrying balls during the rotation of the drum.

SUMMARY OF INVENTION

In accordance with the present invention, a particulate material is subjected to a heat treatment by coming in direct and immediate physical contact with heat transfer media in a continuously rotating cylindrical drum. The drum is provided with a helical blade along the interior circumference wall of the drum which aids in flowing the heat transfer media from one end to the other end of the drum in combination with the rotation of the drum. In another embodiment of the invention, the helical blade is used to flow the particulate material through the drum. The rotation of the drum and blade causes the heat transfer media to flow from one end to the other end of the drum and the particulate material to flow in the opposite direction through the drum in heat transfer relationship. During the rotation of the drum, the particulate material repeatedly comes in direct and immediate physical contact with the heat transfer media while separating it from the heat transfer media through openings of the helical blade or an inner drum that allow the particulate material to pass freely through but that prevent the heat transfer media from passing. In anoher embodiment of the invention, the particulate material is separated from the heat transfer media by difference in the particle size.

An object of this invention is to provide an apparatus and method for repeatedly bringing particulate material into continuous, direct physical contact with a heat transfer media so as to effect an efficient heat exchange therebetween in a rotating cylindrical drum.

Another object of this invention is to provide an apparatus and method for effecting repeated physical separation of particulate material from the heat transfer media in the rotating cylindrical drum.

Yet another object of this invention is to provide an apparatus and method for segregating the particulate material from the heat transfer media prior to their discharge from the cylindrical drum.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts through the several views and wherein:

FIG. 10 is a longitudinal sectional view of a rotary heat exchanger according to a fourth embodiment of the invention.

FIG. 11 is a cross-sectional view taken along the line 11—11 of FIG. 10.

FIG. 12 is a partly broken away longitudinal view showing the inside construction of the rotary heat exchanger shown in FIG. 10.

DETAILED DESCRIPTION OF THE PREFERRED EMBODIMENTS

Figures 1, 2, 3, 4:
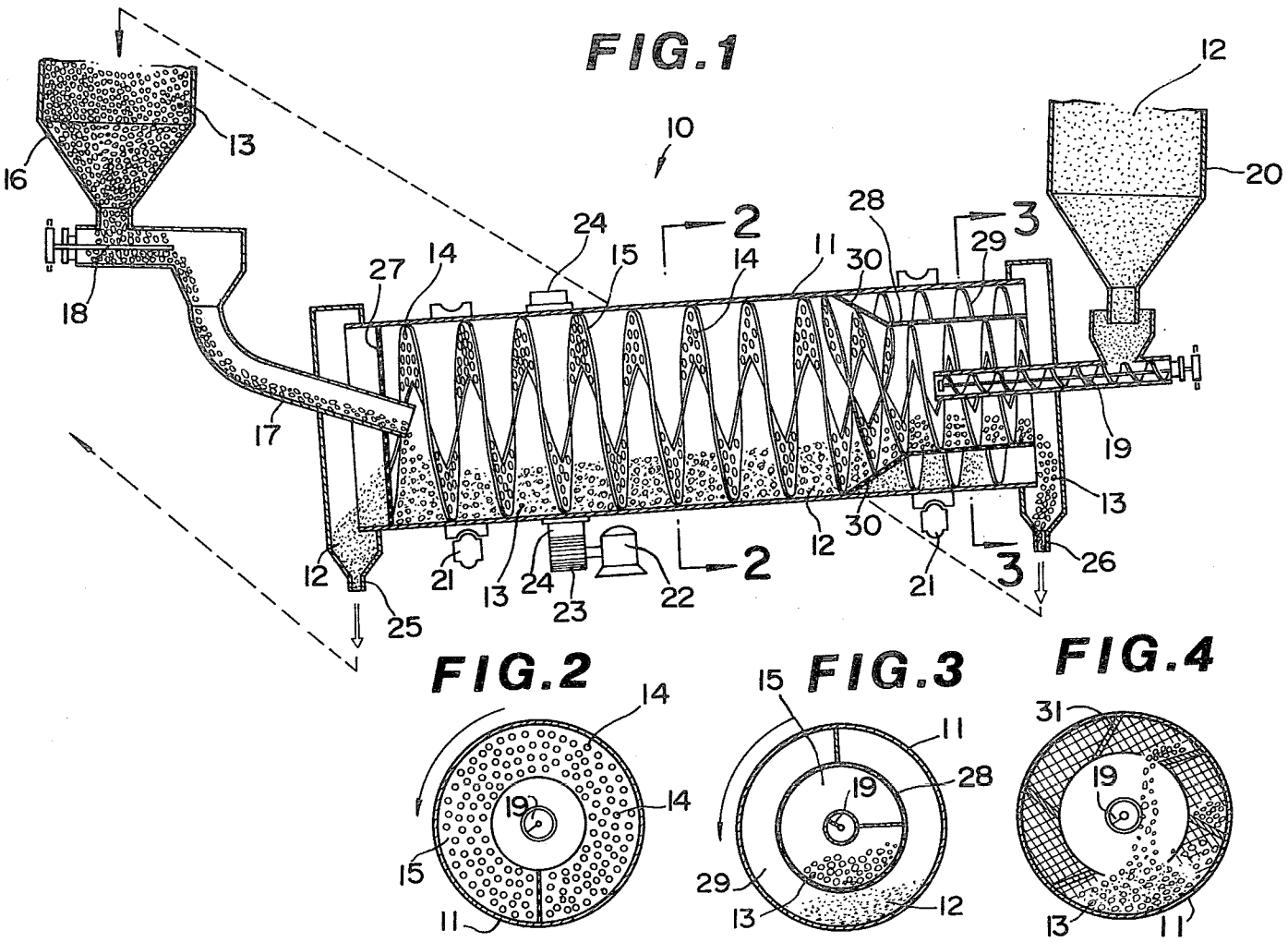
FIG. 1 is a longitudinal sectional view of a rotary heat exchanger according to a first embodiment of the invention.
FIG. 2 is a cross-sectional view taken along the line 2—2 of FIG. 1.
FIG. 3 is a cross-sectional view taken along the line 3—3 of FIG. 1.
FIG. 4 is a cross-sectional view of a modification of the rotary heat exchanger shown in FIG. 1.

Broadly, a rotary heat exchanger of the present invention shown in the drawings is classified into two types. One is a single drum heat exchanger as shown in FIGS. 1 through 9 and the other is a dual drum heat exchanger as shown in FIGS. 10 through 16. To begin with, the single drum heat exchanger of the invention will be explained with reference to FIGS. 1 to 9.

In FIG. 1, the heat exchanger generally indicated by the reference numeral 10 includes a rotatable cylindrical drum 11 for drying or preheating a particulate material 12 by means of heated media 13 which is brought into direct and immediate physical contact with the material 12 to be treated during the rotation of the drum 11.

The heat transfer media 13 is preferably formed of spherical ceramic balls which are superior in abrasion resistance and impact strength against heat and higher in mechanical strength and specific heat, such as, $Al_2O_3$, $Al_2O_3.MgO$, 3 $A1_2O_3.2SiO$, $2MgO.2Al_2O_3.5SiO_2$. The heat transfer media 13 is selected from those which are similar to a part of the ingredients or mixed components of the particulate material 12 to be treated so as to avoid contamination from residues of the heat transfer media 13 due to abrasion during the rotation of the drum. The ceramic ball of smaller particle size is preferably used so as to provide increased areas of contacting with the particulate material 12, but it must be large enough not to pass through openings or perforations 14 provided on a helical blade 15 mounted within the drum 11. The particle size of the ball 13 is variable depending upon the size of opening 14 which is determined by taking the grain size, moisture content and viscosity of the particulate material 12 to be treated into consideration. The usual particle size of the ball 13 is approximately 3 mm to 10 mm in diameter. Instead of the ceramic ball 13, it is possible to use metal balls, such as steel balls. In this instance, the metal balls must be fed in the drum 11 in larger volume per unit hour for treating the particulate material having the same moisture content because the specific heat of the metal balls is less than that of the ceramic balls, which results in an increase in a cost for treating the particulate material. Furthermore, the particulate material is contaminated due to the abrasion during the rotation of the drum 11. Although there are these disadvantages in using the metal balls, the metal balls can be satisfactorily used as a heat transfer media for drying or preheating some sorts of particulate material. The particulate material to be treated in this invention is glass-forming ingredients, cement-forming ingradients, coal dusts, pitches, petroleum residues, shales, clays, muds, and the like.

The heat transfer media 13 is preheated at a predetermined high temperature by direct contact with exhaust gases from a furnace and positioned in a preheat hopper 16. The heated media 13 exits through the bottom of preheat hopper 16 and is introduced into one end of drum 11 through a conduit 17 by a conveyor 18. Concurrently, the particulate material 12 to be dried or heated is fed into the drum 11 from a storage container 20 to the other end of drum 11 by a screw conveyor 19 that extends into the interior of the drum 11.

The cylindrical drum 11 is of substantial length and cross-sectional area and disposed being inclined at an angle of about 3° to 9° with respect to a horizontal line. In the embodiment shown in FIG. 1, the particulate material charging end is elevated above the media charging end. The drum 11 is rotatable upon guide rollers 21 around the inclined axis by a motor 22 and drive consisting of a gear 23 and rack 24. The speed of rotation is about 2 to 5 rpm. Reference numeral 25 designates an outlet conduit for discharging the heat treated particulate material 12 and numeral 26 designates an outlet conduit for discharging the cooled media 13 after having been effected the heat transfer. At both the heat transfer media charging end and particulate material charging end of the drum 11, there are provided screen openings 27 and 28 having a size that allows the particulate material 12 to pass freely through the openings but that prevents the media 13 from passing through the openings. The screen openings 27 are circular in shape and close the heat transfer media charging end of the drum 11 so that the particulate material 12 after having been subjected to the heat treatment may be separated from the heat transfer media 13 and fall into the conduit 25. The screen openings 28 extend into the interior of the drum 11 in a short distance in concentric relationship with the drum 11. Between the screen openings 28 and the interior wall of the drum 11, there is provided a helical blade 29 which directs the particulate material 12 introduced into the drum 11 by the screw conveyor 19 and passed through the screen openings 28 to a tumbling zone where the particulate material 12 comes in direct immediate physical contact with the heat transfer media via a flared portion 30 of the screen openings 28 by the rotation of the drum 11 and helical blade 29. As shown in the drawings, the helical blade 29 is not perforated and curves in the reverse direction to the helical blade 15.

In order to bring the particulate material 12 in direct and immediate physical contact with the heated media 13 and to enhance the heated media to flow in the direction of the elevated end of the drum 11 from left to right and the particulate material 12 to flow in the opposite direction from right to left, the helical blade 15 is attached or welded to the interior of the drum 11 along the circumference wall thereof extending the entire length of the drum 11. The helical blade 15 is provided with a plurality of the openings or perforations 14 having a size that allows the particulate material 12 to pass freely through the perforations 14 but that prevents the heat transfer media 13 from passing through the perforations 14. The rotation of the cylindrical drum 11 and blade 15 causes the heat transfer media 13 and particulate material 12 to whirl along a helical path of the blade 15 and tumble in direct physical contact with each other so as to flow in opposite directions within the cylindrical drum 11. The helical blade 15 in combination with the rotation of the drum 11 permits the heat transfer media 13 to flow in the direction towards the elevated end of the drum 11 efficiently and also aids in tumbling the heat transfer media 13 and particulate material 12 in direct contact repeatedly with each other in the course of flowing in the drum 11. The helical blade 15 having the perforations 14 causes the separation of the particulate material 12 and the heat transfer media 13 from each other per revolution of the drum 11. The rotation of the drum 11 and blade 15 causes the particulate material 12 after having been contacted with the heat transfer media 13 to pass through the openings 14 of the blade 15 and to fall in an adjacent helical path opposite to the flow direction of the heat transfer media in the drum so that the particulate material 12 may be repeatedly contacted with the heat transfer media 13 flowing from the lower end of the drum 11 to the elevated end of the drum 11 along the helical path around the drum 11. In this manner, the particulate material 12 is gradually heated as it flows from the elevated end of the drum 11 to the lower end of the drum 11 in a repeating tumbling free-fall action in the inclined rotary cylindrical drum 11 and to be finally discharged from the outlet conduit 25 through the screen openings 27. The heat transfer media 13 which is cooled after having effected the heat transfer moves along the helical path of the blade 15 towards the elevated end of the drum 11 passing over the screen openings 28 and is discharged from the outlet conduit 26. The openings or perforations 14 are not necessarily required at the cooled media discharging end of the blade 15. The cooled media 13 discharged from the outlet conduit 26 is recycled back to the preheat hopper 16. In an embodiment of the present invention, a screen may be used instead of the openings or perforations 14 and also lifters 31 may be attached to the interior of the drum 11 so as to promote the tumbling free-fall action of the particulate material 12 and the heat transfer media 13 in the drum 11 as shown in FIG. 4.

The rotary heat exchanger of the present invention is capable of very efficiently heating the particulate material 12 and subjecting it to the repeated direct physical contact with the heated media 13 while separating it from the cooled media after having effected the heat transfer. Thus, the particulate material 12 comes in contact with the media 13 many more times than in conventional heat exchangers. As a result, heat transfer efficiency can be remarkably increased, which makes it possible to use a rotary heat exchanger which is smaller in size and rotated at a relatively low speed.

FIGS. 5 through 9 show other embodiments of the rotary heat exchanger of the single drum type according to the present invention. The rotary heat exchangers shown in FIGS. 5 through 9 are almost similar to the rotary heat exchanger shown in FIG. 1 except that there is no opening or perforation in the helical blade for causing the whirling motion in the particulate material and the heat transfer media within the drum and that the mode of arrangement of the blade in the drum is somewhat different from that shown in FIG. 1. Accordingly, the detailed explanation of the rotary heat exchanger in the embodiments will be omitted, and the heat exchangers are shown in a simple manner in the drawings. These heat exchangers are particularly useful for effecting the heat transfer between the particulate material and the heat transfer media wherein the particle size of media is significantly larger than that of the particulate material and the particulate material can be precipitated through the underside of drum being separated from the heat transfer media which lies above the particulate material as a layer during the rotation of the drum. The optimum particle size of the particulate material subjected to the heat treatment in these heat exchangers is less than 12 mesh, while the particle size of the heat transfer media is 10 mm in diameter.

Figure 5:
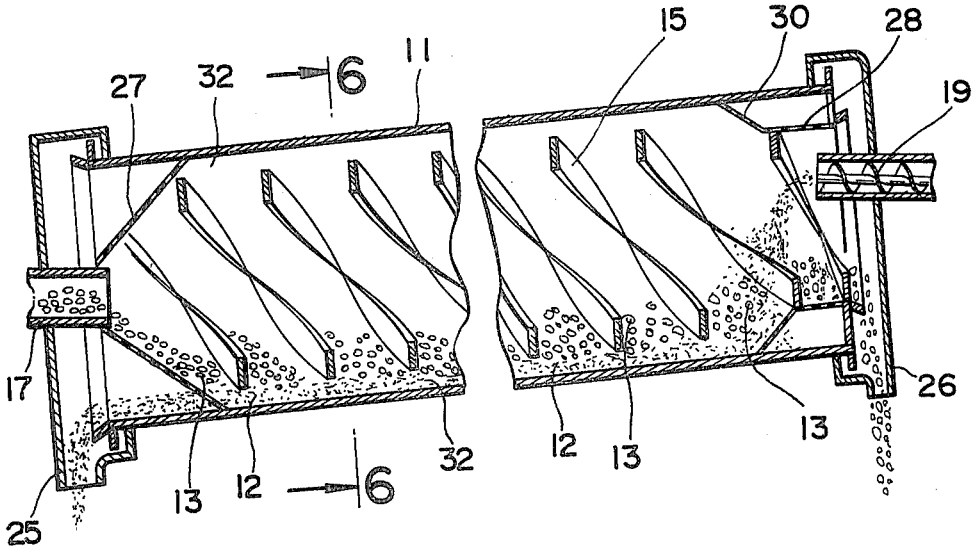
FIG. 5 is a longitudinal sectional view of a rotary heat exchanger according to a second embodiment of the invention.
Figure 6:
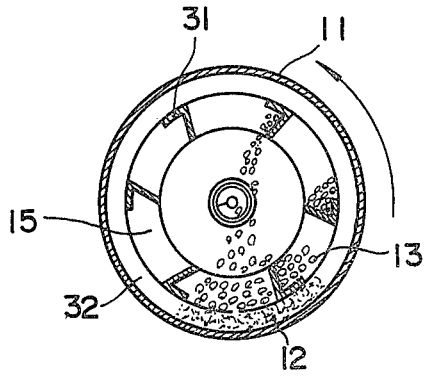
FIG. 6 is a cross-sectional view taken along the line 6—6 of FIG. 5.

Referring to the embodiments shown in FIGS. 5 through 9, the rotary heat exchanger shown in FIG. 5 includes a helical blade 15 mounted within a drum 11 in concentric relationship with the interior of the drum 11 maintaining an annular space 32 between the inner wall of the drum 11 and the blade 15. As shown in FIG. 6, the helical blade 15 is provided with lifters 31 for promoting tumbling free-fall action of particulate materials 12 and heat transfer media 13 in the drum. The rotation of the cylindrical drum 11 and the blade 15 causes the heat transfer media 13 and particulate material 12 to whirl along a helical path of the blade 15 and tumble in direct and physical contact with each other and permits the heat transfer media 13 to flow in the direction of the elevated end of the drum and the particulate material 12 to flow in the opposite direction from the high end to the low end of the drum 11 through the inclined annular space 32.

Figure 7:
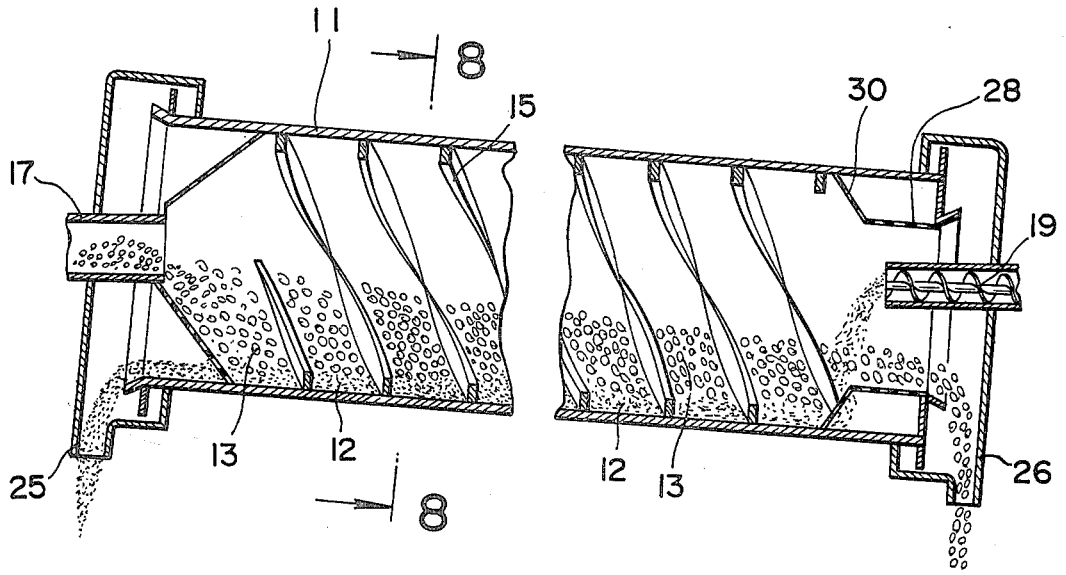
FIG. 7 is a longitudinal sectional view of a rotary heat exchanger according to a third embodiment of the invention.
Figure 8:
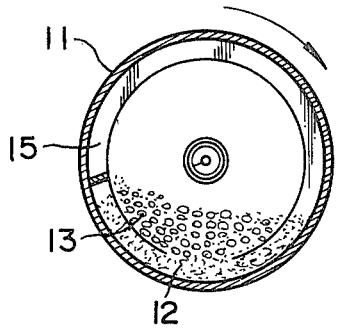
FIG. 8 is a cross-sectional view taken along the line 8—8 of FIG. 7.
Figure 9:
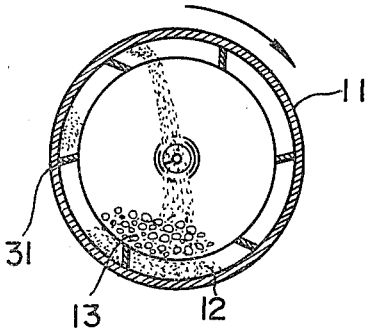
FIG. 9 is a cross-sectional view of a modification of the rotary heat exchanger shown in FIG. 7.

The rotary heat exchanger shown in FIG. 7 comprises a cylindrical drum 11 and a helical blade 15 attached or welded to the interior wall of the drum 11. The drum 11 is inclined at an angle. In this embodiment, the heat transfer media charging end is elevated above the particulate material charging end and the drum is rotated clockwise. The width of helical blade 15 is narrower than that of the blade used in the heat exchangers shown in FIGS. 1 and 5. The ridge of the blade lies in a plane substantially level to the surface of particulate material precipitated through the underside of drum 11. The rotation of the cylindrical drum 11 and blade 15 causes heat transfer media 13 and particulate material 12 to whirl along a helical path of the blade 15 and tumble in direct and physical contact with each other and permits the particulate material 12 to flow in the direction of the elevated end of the drum and the heat transfer media 13 to flow in the opposite direction from the high end to the low end of the drum 11. In order to promote the tumbling fre-fall action of the particulate material 12 and heat transfer media 13 in the drum 11, lifters 31 may be attached to the blade 15 as shown in FIG. 9.

Reference will now be made to the rotary heat exchanger of the dual drum type in connection with FIGS. 10 through 16.

In the embodiment shown in FIG. 10, heat transfer media 13 is preheated at a predetermined high temperature by direct contact with exhaust gases from a furnace and positioned in a preheat hopper 16. The heated media 13 exits through the bottom of preheat hopper 16 and is introduced into one end of cylindrical drum by a screw conveyor 18 that extends into the interior of the drum 11. Concurrently, particulate materials 12 to be dried or preheated are fed into the drum 11 from a storage 20 to the other end of drum 11 by a screw conveyor 19 that extends into the interior of the drum 11.

The cylindrical drum 11 is of substantial length and cross-sectional area and disposed being inclined at an angle of about 3° to 9° with respect to a horizontal line. In the embodiment shown in FIG. 10, the heat transfer media charging end is elevated above the particulate material charging end. The drum 11 is rotatable upon guide rollers 21 around the inclined axis by a motor 22 and drive consisting of a gear 23 and rack 24. The speed of rotation is about 2 to 5 rpm. The cylindrical drum 11 includes a cylindrical drum 33 which is mounted within the drum 11 in concentric relationship with the drum 11 extending the entire length thereof and keeping annular space therebetween. The inner cylindrical drum 33 is made of a punching metal or wire screen having a plurality of perforations or openings 14 and is connected or welded to the outer drum 11 by means of a helical blade 15 disposed in the annular space between the inner drum 33 and the outer drum 11. The openings 14 are such a size that allows the particulate material 12 to pass freely through but that prevents the heat transfer media 13 from passing therethrough.

The helical blade 15 is arranged at the same interval around the outer circumference wall of the inner drum 33. The helical blade 15 may be provied with scraper plates 34 for lifting the particulate material 12 passing through the openings 14 of the inner drum 33 and travelling in the direction of the elevated end of the drum 11 along a helical path 32 in the blade 15 above the charging level of heat transfer media 13 in the inner drum 33 so that it may fall in the inner drum 33 through the openings 14 and come in direct and immediate physical contact with the heated media 13. The scraper plates 34 are preferably arranged at regular intervals around the outer circumference wall of the inner drum 33 being perpendicular to the blade 15 excluding the particulate material charging zone of drum 33. At the heat transfer media discharging end of the drum 33, a barrier 37 is formed so as to keep the heat transfer media at a predetermined volume or height in the inner drum 33 as the heat transfer media flows from the high end to the low end of the drum as the drum rotates. Reference numeral 25 designates an outlet conduit for discharging the heat treated particulate material 12 and numeral 26 designates an outlet conduit for discharging the heat transfer media 13 after having effected the heat transfer.

The rotation of the cylindrical drums 11 and 33 causes the heat transfer media 13 introduced into the inner drum 33 to flow from the high end to the low end of the drum 33 and to come in direct and immediate physical contact with the particulate material 12 within the inner drum 33 which is fed into the interior of the inner drum 33 through the openings 14. The rotation of the cylindrical drums 11 and 33 in combination with the helical blade 15 and scraper plates 34 permits the particulate material 12 introduced into the inner drum 33 to fall into the helical path 32 at the particulate material charging end of the blade 15 through the heat transfer media 13 and the openings 14 of the inner drum 33 and to move towards the elevated end of the drum 11 along the helical path 32 where it is lifted by the scraper plates 34 and fed into the interior of the inner drum 33 through the openings 14 so as to come in direct and immediate physical contact with the heated media 13 in the inner drum 33. The particulate material after having been contacted with the heated media in the inner drum 33 is returned to the helical path 32 through the heat transfer media and the openings 14 of the inner drum 33 so that it may be repeatedly fed into the interior of the inner drum 33. In this manner, the particulate material 12 is gradually heated as it is repeatedly fed into the inner drum 33 through the agitation from the scraper plates 34 and rotation of the drums 11 and 33 and finally discharged from the outlet conduit 25. The heat transfer media flowing from the high end to the low end of the inner drum 33 and passing over the barrier 35 is discharged from the conduit 26 and recycled back to the preheat hopper 16.

In the embodiment shown in FIG. 10, the particulate material 12 can be subjected to the repeated direct physical contact with the heated media 13 while separating it from the cooled media after having been effected the heat transfer. Thus, the particulate material 12 comes in contact with the heat transfer media 13 many more times than in conventional heat exchangers. As a result, heat transfer efficiency can be remarkably increased, which makes it possible to use a rotary heat exchanger which is smaller in size and rotated at a relatively low speed.

FIGS. 13 through 16 show other embodiments of the rotary heat exchanger of the dual drum type according to the present invention. In the embodiments shown in FIGS. 13 through 16, heat transfer media 13 and particulate materials 12 are introduced into a drum from both ends of the drum by means of the same screw conveyors as shown in FIG. 10. The drum comprises an outer drum 11 and inner drum 33 having a plurality of openings or perforations 14 which permit the particulate material 12 to pass through and prevent the heat transfer media 13 from passing therethrough and outer drum 11 rotates upon guide rollers 21 by a motor and drive.

Figure 13:
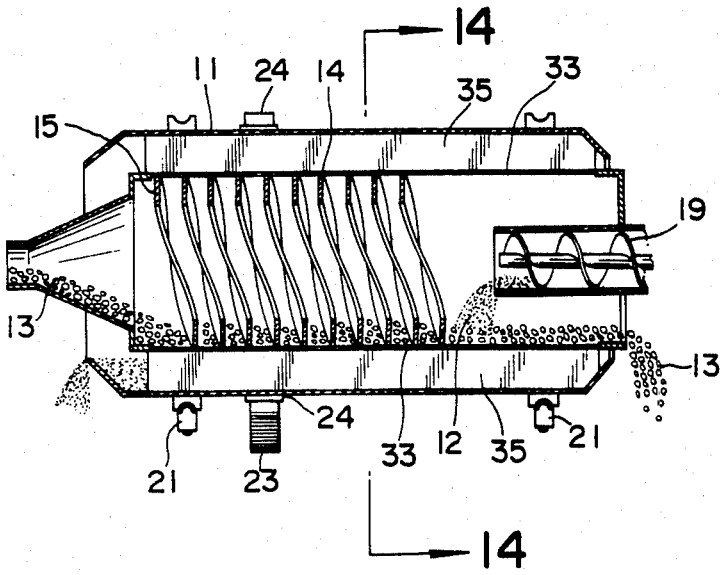
FIG. 13 is a longitudinal sectional view of a rotary heat exchanger according to a fifth embodiment of the invention.
Figure 14:
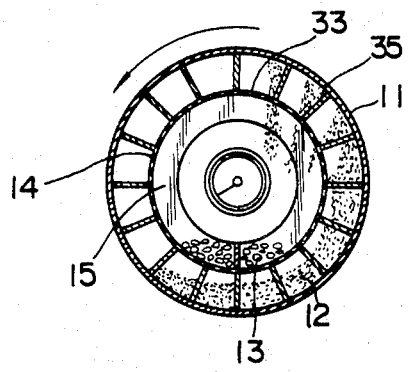
FIG. 14 is a cross-sectional view taken along the line 14—14 of FIG. 13.

The rotary heat exchanger shown in FIG. 13 is disposed being inclined at an angle. In this embodiment, the particulate material charging end is elevated above the heat transfer media charging end. An annular space between the outer drum 11 and the inner drum 33 is divided into longitudinally extending channels by means of plates 35 which are connected or welded to the outer and inner drums 11 and 33 and radially extending along the entire length of the drums. In order to bring the particulate material 12 in direct and immediate physical contact with the heated media 13 and to enhance the heated media 13 to flow in the direction of towards the elevated end of the drum from left to right, a helical blade 15 is attached or welded to the interior of the inner drum 33 along the circumference wall thereof extending a substantial length of the inner drum 33 excluding the particulate material charging zone of the inner drum 33.

The rotation of the cylindrical drums 11 and 33 causes the heat transfer media 13 introduced into the inner drum 33 to flow from the low end to the high end of the drum 33 along a helical path of the blade 15 and the particulate material 12 to flow from the high end to the low end of the drum along the longitudinal channels formed between the outer drum 11 and the inner drum 33. During the rotation of the drums 11 and 33, the heat transfer media 13 and the particulate material 12 come in repeated direct and immediate physical contact with each other in the inner drum 33. The rotation of the cylindrical drums 11 and 33 in combination with the helical blade 15 and the plates 35 permits the particulate material 12 introduced into the inner drum 33 to fall into the longitudinal channels at the particulate material charging zone through the heat transfer media 13 and the openings 14 of the inner drum 33 and to move toward the low end of the drum along the longitudinal channels where it is lifted by the plates 35 and fed into the interior of the inner drum 33 through the openings 14 so as to come in direct and immediate physical contact with the heated media 13 whirling in the inner drum through the agitation from the helical blade 15 and rotation of the drums. The particulate material after having been contacted with the heated media in the inner drum 33 is returned to the channels through the openings 14 of the inner drum 33 so that it may be repeatedly fed into the interior of the inner drum 33.

Figure 15:
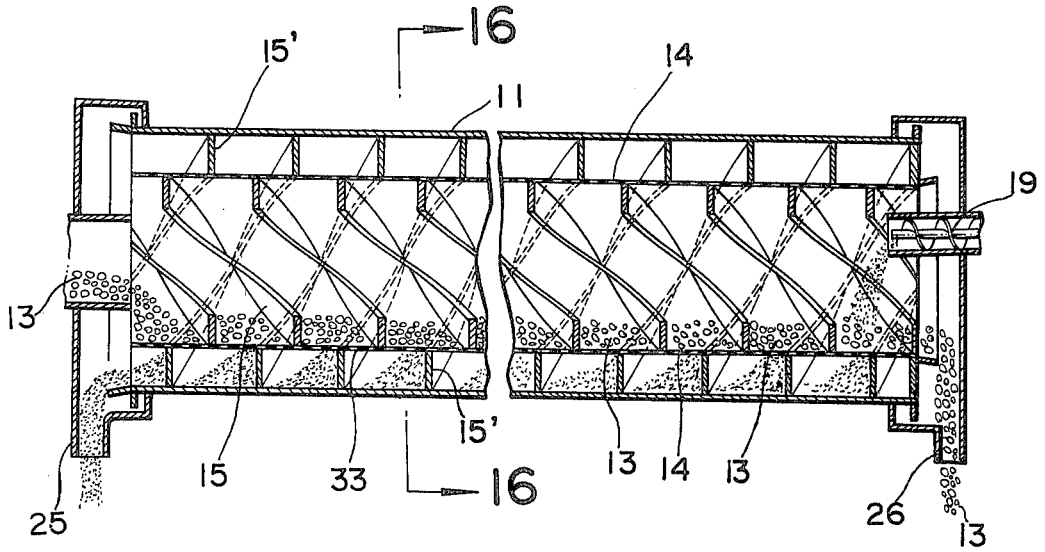
FIG. 15 is a longitudinal sectional view of a rotary heat exchanger according to a sixth embodiment of the invention.
Figure 16:
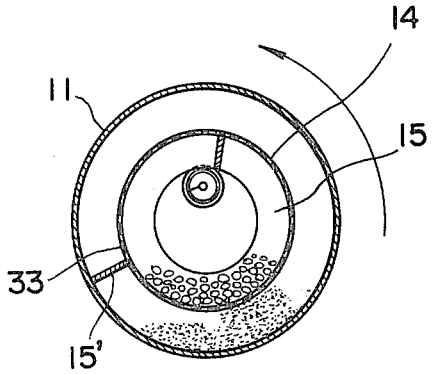
FIG. 16 is a cross-sectional view taken along the line 16—16 of FIG. 15.

In the rotary heat exchanger shown in FIG. 15, an arrangement of helical blades 15 and 15' are attached to the interior of inner cylindrical drum and annular space between the inner and outer drums 11 and 33 respectively and the drums are rotated around a substantially horizontal axis. The helical blades 15 and 15' are curved in reverse directions with respect to one another for permitting particulate material 12 and heat transfer media 13 to flow in opposite directions as the drums rotate. The rotation of the drums in combination with the helical blades 15 and 15' causes the particulate material 12 flowing along a helical path of blade 15' to be introduced into the inner drum 33 through its openings 14 so as to come in direct and immediate physical contact with the heated media 13 whirling in the inner drum through the agitation from the helical blade 15 and rotation of the drums. The particulate material after having been contacted with the heated media in the inner drum 33 is returned to the helical path of blade 15' through the openings 14 of the inner drum 33 so that it may be repeatedly fed into the interior of the inner drum 33. In order to promote lifting free-fall action of the particulate material, a scraper plate may be attached to the helical blade 15'.

Obviously, numerous modifications and variations of the present invention are possible in light of the above teachings. It is therefore to be understood that within the scope of the appended claims, the invention may be practiced otherwise than as specifically described herein.

What is claimed is as new and desired to be secured by Letters Patent of the United States is:

1. A process for drying or heating a particulate material comprising the steps of:

introducing the particulate material into one end of a continuously rotating cylindrical drum which is of substantial length and cross-sectional area, said drum being provided with a helical path around the interior circumference wall thereof extending substantially an entire length of the drum;

introducing heat transfer media into an other end of the drum, said heat transfer media being larger in parricle size than the particulate material and preheated before introducing into the drum;

moving the heat transfer media along the helical path in the drum towards the particulate material charging end of the drum and the particulate material in the opposite direction through the drum in accordance with the rotation of the drum, whereby the particulate material is repeatedly brought in direct and immediate physical contact with the heat transfer media and subsequently separated from the heat transfer media;

segregating the particulate material from the heat transfer media at the one end of the drum;

segregating the heat transfer media from the particulate material at the other end of the drum; and discharging the heat transfer media at one end of the drum and the particulate material at the other end of the drum.

2. The process according to claim 1 wherein the particulate material moves along the helical path in the drum towards the heat transfer media charging end of the drum, while the heat transfer media moves in the opposite direction through the drum.

3. The process according to claim 1 wherein the heat transfer media and the particulate material move along helical paths in the interior of the drum extending substantially the entire length thereof.

4. The process according to claim 1 or 2 wherein the helical path is formed of a helical blade attached to the interior of the drum.

5. The process according to claim 3 wherein the helical paths are formed of helical blades attached to the interior of the drum, said helical blades being curved in reverse directions with respect to one another for permitting the particulate material and the heat transfer media to flow in the opposite directions.

6. The process according to claim 1 wherein the particulate material is separated from the heat transfer media through openings provided on a helical blade attached to the interior of the drum, the openings of the helical blade having a size that allows the particulate material to pass freely through the openings but that prevents the heat transfer media from passing through the openings.

7. The process according to claim 1 wherein the particulate material is separated from the heat transfer media by difference in particle size between the particulate material and the heat transfer media.

8. The process according to claim 1, 2 or 3 wherein the particulate material is separated from the heat transfer media through openings provided on an inner drum mounted within the drum in concentric relationship therewith maintaining an annular space therebetween, the openings of the inner drum having a size that allows the particulate material to pass freely through the openings but that prevents the heat transfer media from passing through the openings.

9. The process according to claim 8 wherein the heat transfer media flows in one direction through the inner drum and the particulate material flows in the opposite direction through the annular space.

10. The process according to claim 9 wherein the heat transfer media moves along the helical path in the inner drum.

11. The process according to claim 9 wherein the particulate material moves along the helical path in the annular space.

12. The process according to claim 1 wherein the drum is rotatable around an axis being inclined to the horizontal.

13. The process according to claim 1 wherein the particulate material is one selected from a group consisting of glass-forming ingredients, cement-forming ingredients, coal dusts, pitches, petroleum residues, shales, clays, and muds.

14. The process according to claim 1 wherein the heat transfer media is a ceramic ball selected from a group consisting of $Al_2O_3$, $Al_2O_3.MgO$, $3Al_2O_3.2SiO$, and $2MgO.2Al_2O_3.5SiO_2$.

15. An apparatus for drying or heating a particulate material comprising:

a rotary cylindrical drum having a substantial length and a substantial cross sectional area;

means for introducing a heat transfer media, larger in particle size than the particulate material and preheated at a predetermined high temperature, into one end of the drum for movement in one direction through the drum for discharge;

means for introduing the particulate material into the other end of the drum for movement in an opposite direction through the drum for discharge;

means associated with an interior of the drum for causing the heat transfer media to whirl along a circumference wall of the drum and to come in direct and immediate physical contact with the particulate material during the rotation of the drum;

means associated with the interior of the drum for separating the particulate material from the heat transfer media after having been effected heat transfer and for repeatedly bringing the particulate material in direct and immediate physical contact with the heat transfer media of a higher temperature than that previously contacted during the rotation of the drum;

means constructed and positioned at one end of the drum for segregating the particulate material from the heat transfer media;

means constructed and positioned at the other end of the drum for segregating the heat transfer media from the particulate material; and means for discharging the heat transfer media at one end of the drum and the particulate material at the other end of the drum.

16. The apparatus according to claim 15 wherein the means for causing the heat transfer media to whirl along the circumference wall of the drum further comprises a helical blade attached to the interior of the drum along the circumference wall thereof extending substantially the entire length of the drum.

17. The apparatus according to claim 15 wherein the means for separating the particulate material from the heat transfer media further comprises a helical blade having a plurality of openings that allow the particulate material to pass freely through the openings but that prevent the heat transfer media from passing through the openings, the helical blade being attached to the interior of the drum along the circumference wall thereof extending substantially the entire length of the drum.

18. The apparatus according to claim 15 wherein the means for separating the particulate material from the heat transfer media further comprises an internal drum having a plurality of openings that allow the particulate material to pass freely through the plurality of openings but that prevent the heat transfer media from passing through the plurality openings, the internal drum being arranged in concentric relationship with the interior circumference wall of the drum and extending substantially the entire length thereof and maintaining an annular space therebetween.

19. The apparatus according to claim 16 wherein the helical blade is attached to the interior of the drum in concentric relationship with the interior circumference wall of the drum maintaining an annular space therebetween.

20. An apparatus for drying or heating a particulate material comprising:

a rotary cylindrical drum having a substantial length and a substantial cross sectional area;

means for introducing a heat transfer media, larger in particle size than the particulate material and preheated at a predetermined high temperature, into one end of the drum for movement in one direction through the drum for dicharge;

means for introducing the particulate material into the other end of the drum for movement in an opposite direction through the drum for discharge;

means associated with an interior of the drum for causing the particulate material to whirl along a circumference wall of the drum and to come in direct and immediate physical contact with the heat transfer media during the rotation of the drum;

means associated with the interior of the drum for separating the particulate material from the heat transfer media after having been effected heat transfer and repeatedly bringing the particulate material in direct and immediate physical contact with the heat transfer media of a higher temperature than that previously contacted during the rotation of the drum;

means constructed and positioned at one end of the drum for segregating the particulate material from the heat transfer media;

means constructed and positioned at the other end of the drum for segregating the heat transfer media from the particulate material; and means for discharging the heat transfer media at one end of the drum and the particulate material at the other end of the drum.

21. The apparatus according to claim 21 wherein the means for causing the particulate material to whirl along the circumference wall of the drum further comprises a helical blade attached to the interior of the drum along the circumference wall thereof extending substantially the entire length of the drum.

22. The apparatus according to claim 21 wherein a ridge of the helical blade lies in a plane substantially level to a surface of the particulate material precipitated at an underside of the drum as a layer.

23. The apparatus according to claim 20 wherein the means for separating the particulate material from the heat transfer media further comprises an internal drum having a plurality of openings that allow the particulate material to pass freely through the plurality of openings but that prevent the heat transfer media from passing through the plurality of openings, the internal drum being arranged in concentric relationship with the interior circumference wall of the drum and extending substantially the entire length thereof and maintaining an annular space therebetween.

24. The apparatus according to claim 16 or 21 wherein the helical blade further comprises lifter or scraper plates associated therewith for promoting tumbling free-fall action of the particulate material and the heat transfer media in the drum.

25. A process for drying or heating a particulate material comprising the steps of:

introducing the particulate material into one end of a continuously rotating cylindrical drum having a substantial length and a substantial cross-sectional area, said drum being provided with a helical path around an interior circumference wall thereof extending substantially an entire length of the drum;

introducing a heat transfer media into an other end of the drum, said heat transfer media being larger in particle size than the particulate material and preheated before introducing into the drum;

moving the heat transfer media along the helical path in the drum towards a particulate material charging end of the drum and the particulate material in an opposite direction through the drum in accordance with the rotation of the drum, the particulate material moving along the helical path in the drum towards a heat transfer media charging end of the drum, while the heat transfer media moves in an opposite direction through the drum, helical paths in the interior of the drum extending substantially the entire length thereof and wherein the helical paths are formed of helical blades attached to an interior of the drum, said helical blades being curved in reverse directions with respect to one another for permitting the particulate material and the heat transfer media to flow in the opposite directions whereby the particulate material is repeatedly brought in direct and immediate physical contact with the heat transfer media and subsequently separated from the heat transfer media; and discharging the heat transfer media at one end of the drum and the particulate material at the other end of the drum.

26. A process for drying or heating a particulate material comprising the steps of:

introducing the particulate material into one end of a continuously rotating cylindrical drum having a substantial length and a substantial cross-sectional area, said drum being provided with a helical path around an interior circumference wall thereof extending substantially an entire length of the drum;

introducing a heat transfer media into an other end of the drum, said heat transfer media being larger in particle size than the particulate material and preheated before introducing into the drum;

moving the heat transfer media along the helical path in the drum towards a particulate material charging end of the drum and the particulate material in an opposite direction through the drum in accordance with the rotation of the drum, whereby the particulate material is repeatedly brought in direct and immediate physical contact with the heat transfer media and subsequently separated from the heat transfer media and wherein the particulate material is separated from the heat transfer media through a plurality of openings provided on an inner drum mounted within the drum in concentric relationship therewith and maintaining an annular space therebetween, the plurality of openings of the inner drum having a size that allows the particulate material to pass freely therethrough but that prevents the heat transfer media from passing through the plurality of openings; and discharging the heat transfer media at one end of the drum and the particulate material at the other end of the drum.

27. The process according to claim 26 wherein the heat transfer media flows in one direction through the inner drum and the particulate material flows in the opposite direction through the annular space.

28. The process according to claim 27 wherein the heat transfer media moves along a helical path in the inner drum.

29. The process according to claim 27 wherein the particulate material moves along the helical path in the annular space.

30. An apparatus for drying or heating a particulate material, comprising:

a rotary cylindrical drum having a substantial length and a substantial cross sectional area;

means for introducing a heat transfer media, larger in particle size than the particulate material and preheated at a predetermined high temperature, into one end of the drum for movement in one direction through the drum for discharge;

means for introducing the particulate material into an other end of the drum for movement in an opposite direction through the drum for discharge;

means associated with an interior of the drum for causing the heat transfer media to whirl along a circumference wall of the drum and to come in direct and immediate physical contact with the particulate material during the rotation of the drum;

means associated with the interior of the drum for separating the particulate material from the heat transfer media after having been effected heat transfer and for repeatedly bringing the particulate material in direct and immediate physical contact with the heat transfer media of a higher temperature than that previously contacted during the rotation of the drum, said means for separating the particulate material from the heat transfer media further comprising an internal drum having a plurality of openings that allow the particulate material to pass freely therethrough but that prevent the heat transfer media from passing through the plurality of openings, the internal drum being arranged in concentric relationship with the interior circumference wall of the drum and extending substantially the entire length thereof and maintaining an annular space therebetween; and means for discharging the heat transfer media at one end of the drum and the particulate material at the other end of the drum.

31. An apparatus for drying or heating a particulate material, comprising:

a rotary cylindrical drum having a substantial length and a substantial cross sectional area;

means for introducing a heat transfer media, larger in particle size than the particulate material and preheated at a predetermined high temperature, into one end of the drum for movement in one direction through the drum for discharge;

means for introducing the particulate material into an other end of the drum for movement in an opposite direction through the drum for discharge;

means associated with an interior of the drum for causing the particulate material to whirl along a circumference wall of the drum and to come in direct and immediate physical contact with the heat transfer media during the rotation of the drum;

means associated with the interior of the drum for separating the particulate material from the heat transfer media after having been effected heat transfer and for repeatedly bringing the particulate material in direct and immediate physical contact with the heat transfer media of a higher temperature than that previously contacted during the rotation of the drum, said means for separating the particulate material from the heat transfer media further comprising an internal drum having a plurality of openings that allow the particulate material to pass freely therethrough but that prevent the heat transfer media from passing through the plurality of openings, the internal drum being arranged in concentric relationship with the interior circumference wall of the drum and extending substantially the entire length thereof and maintaining an annular space therebetween; and means for discharging the heat transfer media at one end of the drum and the particulate material at the other end of the drum.

32. A process for drying or heating a particulate material comprising the steps of:

introducing the particulate material into one end of a continuously rotating cylindrical drum having a substantial length and a substantial cross-sectional area, said drum being provided with a helical path around an interior circumference wall thereof extending substantially an entire length of the drum;

introducing a heat transfer media into an other end of the drum, said heat transfer media being smaller in particle size than the particulate material and preheated before introducing into the drum;

moving the particulate material along the helical path in the drum towards a heat transfer media charging end of the drum and the heat transfer media in an opposite direction through the drum in accordance with the rotation of the drum, whereby the heat transfer media is repeatedly brought in direct and immediate physical contact with the particulate material and subsequently separated from the particulate material and wherein the heat transfer media is separated from the particulate material through a plurality of openings provided on an inner drum mounted within the drum in concentric relationship therewith and maintaining an annular space therebetween, the plurality of openings of the inner drum having a size that allows the heat transfer media to pass freely therethrough but that prevents the particulate material from passing through the plurality of openings; and discharging the heat transfer media at one end of the drum and the particulate material at the other end of the drum.

* * * * *